US008928570B2

(12) United States Patent
Kim et al.

(10) Patent No.: US 8,928,570 B2
(45) Date of Patent: Jan. 6, 2015

(54) METHOD OF DRIVING A LIQUID CRYSTAL DISPLAY DEVICE BY USING POLARITY REVERSAL OF A COMMON VOLTAGE

(75) Inventors: Il-Nam Kim, Yongin (KR); Jae-Ik Lim, Yongin (KR); Won-Sang Park, Yongin (KR)

(73) Assignee: Samsung Display Co., Ltd., Giheung-Gu, Yongin, Gyeonggi-Do (KR)

( * ) Notice: Subject to any disclaimer, the term of this patent is extended or adjusted under 35 U.S.C. 154(b) by 554 days.

(21) Appl. No.: 13/050,382

(22) Filed: Mar. 17, 2011

(65) Prior Publication Data

US 2012/0113083 A1 May 10, 2012

(30) Foreign Application Priority Data

Nov. 9, 2010 (KR) ..... 10-2010-0110995

(51) Int. Cl.

*G09G 3/36* (2006.01)
*G09G 3/34* (2006.01)
*G09G 3/20* (2006.01)

(52) U.S. Cl.

CPC ..... *G09G 3/344* (2013.01); *G09G 3/3655* (2013.01); *G09G 3/2014* (2013.01); *G09G 3/2018* (2013.01); *G09G 3/3677* (2013.01); *G09G 3/3688* (2013.01); *G09G 2300/0486* (2013.01); *G09G 2310/0245* (2013.01); *G09G 2310/0267* (2013.01); *G09G 2310/0275* (2013.01)

USPC ..... 345/96; 345/209

(58) Field of Classification Search

USPC ..... 345/209, 212, 90, 96

See application file for complete search history.

(56) References Cited

U.S. PATENT DOCUMENTS

| | | | | |
|---|---|---|---|---|
| 6,819,310 | B2 | 11/2004 | Huang et al. | |
| 7,432,895 | B2 | 10/2008 | Mi | |
| 2002/0008688 | A1 * | 1/2002 | Yamamoto et al. | 345/98 |
| 2003/0160775 | A1 * | 8/2003 | Kumada et al. | 345/209 |
| 2005/0001808 | A1 | 1/2005 | Lee | |
| 2007/0229447 | A1 * | 10/2007 | Takahara et al. | 345/102 |
| 2009/0002586 | A1 * | 1/2009 | Kimura | 349/39 |

FOREIGN PATENT DOCUMENTS

| | | |
|---|---|---|
| KR | 10-2004-00387412 | 5/2004 |
| KR | 10-2005-0112655 | 12/2005 |
| KR | 10-2007-0042337 | 4/2007 |
| KR | 10-0741894 | 7/2007 |

* cited by examiner

*Primary Examiner* — Long D Pham
(74) *Attorney, Agent, or Firm* — Robert E. Bushnell, Esq.

(57) ABSTRACT

A method of driving a display device by using a pixel voltage corresponding to a difference between a common voltage and a data voltage comprises: operations of charging the pixel voltage by the common voltage and the data voltage having opposite polarities; and discharging the pixel voltage in a period where the polarity of the common voltage is reversed.

17 Claims, 10 Drawing Sheets

METHOD OF DRIVING A LIQUID CRYSTAL DISPLAY DEVICE BY USING POLARITY REVERSAL OF A COMMON VOLTAGE

CLAIM OF PRIORITY

This application makes reference to, incorporates the same herein, and claims all benefits accruing under 35 U.S.C. §119 from an application earlier filed in the Korean Intellectual Property Office on Nov. 9, 2010 and there duly assigned Serial No. 10-2010-0110995.

BACKGROUND OF THE INVENTION

1. Field of the Invention

The present invention relates to a method of driving a display device, and more particularly, to a method of driving a display device via a high withstand voltage.

2. Description of the Related Art

At present, widely used display devices include a liquid crystal display device (LCD), a plasma display panel (PDP), an organic light emitting device (OLED), and the like. The display devices form an image by using a separate light source as in the LCD, or by self-emitting light as in the PDP and the OLED. Thus, a great amount of power consumption is required to drive the existing display devices, including the LCD, the PDP, or the OLED.

As new display devices, an electrophoresis display device and a cholesteric liquid crystal display device have been proposed. The electrophoresis display device and the cholesteric liquid crystal display device are used as electronic paper, and since they are reflective types which do not use a separate light source, they require only a small amount of power consumption.

The electrophoresis display device uses a plurality of pixels including cells, each cell containing two types of minute particles which are charged to different polarities between two electrodes. The electrophoresis display device, as a next generation display device having a paper-like form, has been highlighted for its excellent contrast ratio, visibility, fast response speed, natural color display, low cost, and convenient portability.

The cholesteric liquid crystal display device uses one or more pixels having a cholesteric liquid crystal material layer capable of being in one of a plurality of states between two electrodes. The cholesteric liquid crystal display device has excellent characteristics, including semi-permanent display continuance (a memory property), vivid color display, high contrast, high definition, and the like.

SUMMARY OF THE INVENTION

The present invention provides a method of driving a display device, wherein a high withstand pixel voltage may be applied to the display device without damaging a switching device.

According to an aspect of the present invention, a method of driving a display device by using a pixel voltage corresponding to a difference between a common voltage and a data voltage comprises the steps of: charging the pixel voltage by the common voltage and the data voltage having opposite polarities; and discharging the pixel voltage in a period where the polarity of the common voltage is reversed.

The step of discharging the pixel voltage may include the operations of discharging the pixel voltage to a first level by the common voltage and the data voltage having the same polarities; and discharging the pixel voltage to a second level by the common voltage and the data voltage having the same levels.

The polarity of the common voltage may be reversed when the pixel voltage outputs a voltage of the second level.

The step of discharging the pixel voltage may include the operation of discharging the pixel voltage to a third level by the common voltage and the data voltage having the same polarities.

The polarity of the common voltage may be reversed, when the pixel voltage outputs a voltage of the third level.

The display device may include a cholesteric liquid crystal display device or an electrophoresis display device.

According to another aspect of the present invention, a method of driving a display device by using a pixel voltage corresponding to a difference between a common voltage and a data voltage comprises the steps of: resetting a first pixel voltage by discharging the first pixel voltage charged by the common voltage and the data voltage having opposite polarities in a period where the polarity of the common voltage is reversed; and expressing a grayscale according to a second pixel voltage which is lower than the first pixel voltage and which is charged by the common voltage and the data voltage having opposite polarities, and discharging the second pixel voltage in the period where the polarity of the common voltage is reversed.

The step of resetting the first pixel voltage may include the operations of: discharging the first pixel voltage to a first level by the common voltage and the data voltage having the same polarities; and discharging the first pixel voltage to a second level by the common voltage and the data voltage having the same levels.

The step of discharging the second pixel voltage may include the operation of discharging the second pixel voltage to a third level by the common voltage and the data voltage having the same polarities.

The grayscale may vary according to a pulse width of the second pixel voltage.

The step of resetting the first pixel voltage may include the operation of discharging the first pixel voltage by the common voltage and the data voltage having the same polarities and levels when the data voltage is equal to or greater than a half of the first pixel voltage.

The display device may include a cholesteric liquid crystal display device or an electrophoresis display device.

According to another aspect of the present invention, a method of driving a display device by using a pixel voltage corresponding to a difference between a common voltage and a data voltage comprises the steps of: resetting a first pixel voltage by discharging the first pixel voltage charged by the common voltage and the data voltage having opposite polarities in a period where the polarity of the common voltage is reversed; and expressing a grayscale by a second pixel voltage which is charged by the common voltage and the data voltage having opposite polarities.

The step of resetting the first pixel voltage may include the operation of discharging the first pixel voltage by the common voltage and the data voltage having same polarities and levels when the data voltage is equal to or greater than a half of the first pixel voltage.

The grayscale may vary according to the number of pulses of the second pixel voltage.

The second pixel voltage may be a half of the first pixel voltage.

The display device may comprise a cholesteric liquid crystal display device.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings, in which like reference symbols indicate the same or similar components, wherein.

DETAILED DESCRIPTION OF THE INVENTION

Figure 1:
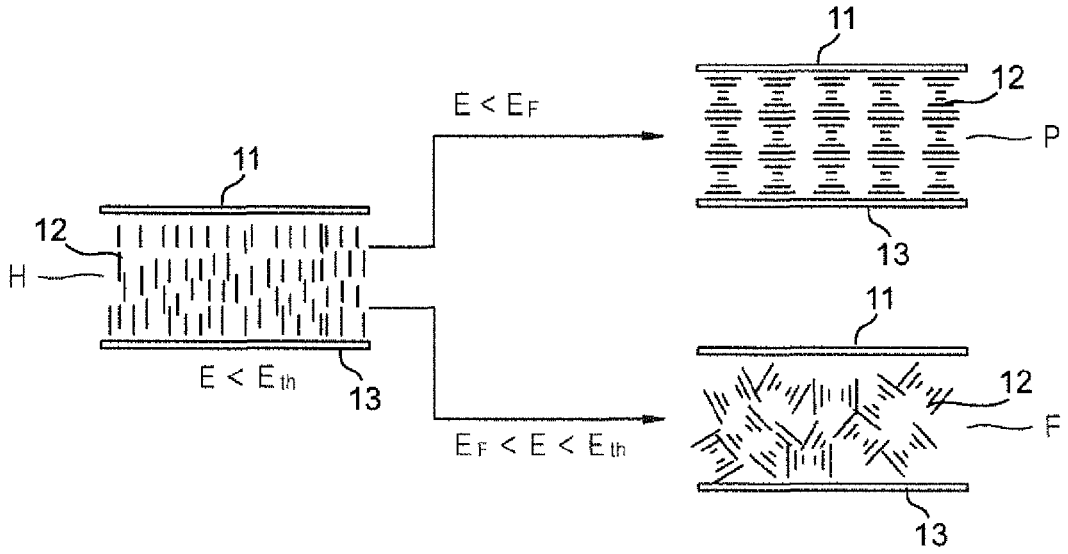
FIG. 1 is diagram for describing the state of a cholesteric liquid crystal cell.

Hereinafter, the present invention will be described in detail by explaining exemplary embodiments of the invention with reference to the attached drawings. Like reference numerals in the drawings denote like elements. In the following description, well-known functions or constructions are not described in detail since they would obscure the invention with unnecessary detail. In the drawings, some regions are exaggerated for clarity.

As used herein, the term "and/or" includes any and all combinations of one or more of the associated listed items.

FIG. 1 is diagram for describing the state of a cholesteric liquid crystal cell.

As illustrated in FIG. 1, a cholesteric liquid crystal display device 10 includes an upper substrate 11, a cholesteric liquid crystal layer 12, and a lower substrate 13. Referring to FIG. 1, when a voltage E applied to the cholesteric liquid crystal layer 12 is higher than a first threshold voltage $E_{th}$, the cholesteric liquid crystal layer 12 is in a homeotropic state H. In the homeotropic state H, particles of the cholesteric liquid crystal layer 12 are vertically aligned with respect to a surface of the cholesteric liquid crystal layer 12.

When the voltage E applied to the cholesteric liquid crystal layer 12 in the homeotropic state H is lower than the first threshold voltage $E_{th}$ and higher than a second threshold voltage $E_F$, in other words, when the voltage E applied to the cholesteric liquid crystal layer 12 in the homeotropic state H is gradually decreased, the cholesteric liquid crystal layer 12 is changed from the homeotropic state H to a focal conic state F. In the focal conic state F, the particles of the cholesteric liquid crystal layer 12 have a helical structure, and a helical axis of the helical structure is aligned almost in parallel with the surface of the cholesteric liquid crystal layer 12. Accordingly, a large portion of light is not reflected but passes through the cholesteric liquid crystal layer 12, and thus the cholesteric liquid crystal layer 12 is in an almost transparent status.

Meanwhile, when the voltage E applied to the cholesteric liquid crystal layer 12 in the homeotropic state H is lower than the second threshold voltage $E_F$, when the voltage E which is applied to the cholesteric liquid crystal layer 12 in the homeotropic state H is sharply decreased, the cholesteric liquid crystal layer 12 is changed from the homeotropic state H to a planar state P via a transient-planar state and an incomplete-planar state. In the planar state P, the particles of the cholesteric liquid crystal layer 12 have a periodic helical structure, and a helical axis of the periodic helical structure is vertically aligned with respect to the surface of the cholesteric liquid crystal layer 12. Accordingly, only a wavelength corresponding to a product nP of an average refractive index n and a helical pitch P of the cholesteric liquid crystal layer 12 may be reflected by the surface of the cholesteric liquid crystal layer 12.

Figure 2:
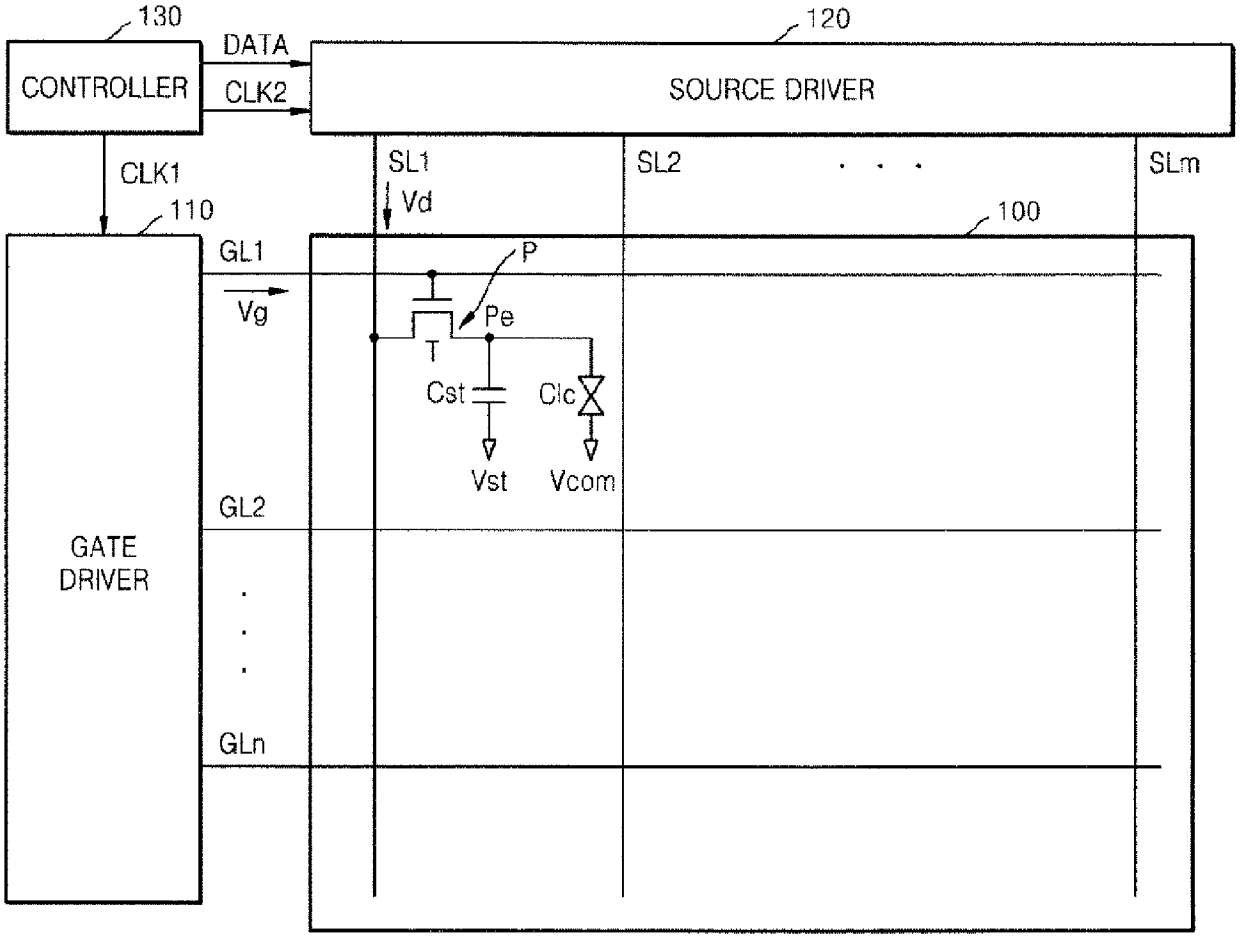
FIG. 2 is a circuit diagram of the structure of a display device according to an embodiment of the present invention.

FIG. 2 is a circuit diagram of the structure of a display device according to an embodiment of the present invention. The display device may include an electrophoresis display device and a cholesteric liquid crystal display device.

Referring to FIG. 2, a gate driver 110 receives a clock signal CLK1 from a controller 130, and simultaneously applies a gate voltage Vg to gate electrode lines GL1 through GLn of a panel 100 at predetermined timings.

A source driver 120 receives a clock signal CLK2 from the controller 130, and simultaneously applies a data voltage Vd to source electrode lines SL1 thru SLn of the panel 100 at predetermined timings.

The controller 130 controls the gate driver 110 and the source driver 120, and simultaneously supplies the clock signal CLK2 and a data signal DATA, indicating information to be displayed on the panel 100, to the source driver 120, and supplies the clock signal CLK1 to the gate driver 110.

The panel 100 includes a plurality of pixels P which are formed in cross regions between the gate electrode lines GL1 thru GLn and the source electrode lines SL1 thru SLn, respectively. Each pixel P includes a switching device T, a display cell Clc, and a storage capacitor Cst. The display cell Clc indicates an electrophoresis cell in the electrophoresis display device, and indicates a liquid crystal cell in the cholesteric liquid crystal display device. Hereinafter, for convenience of description, the display cell Clc is assumed to include both the electrophoresis cell and the liquid crystal cell.

The switching device T may comprise a thin film transistor (TFT). A gate of the switching device T is electrically connected to one gate electrode line GL, and a source or a drain of the switching device T is electrically connected to one source electrode line SL. When the switching device T is turned ON by the gate voltage Vg applied via the gate electrode line GL, the switching device T delivers the data voltage Vd from the source electrode line SL to a pixel electrode Pe. An end of the display cell Clc is connected to the pixel electrode Pe, and another end of the display cell Clc is connected to a common electrode (not shown). An electrical potential difference between the data voltage Vd and a common voltage Vcom is charged in the display cell Clc, wherein the data voltage Vd is applied to the pixel electrode Pe and the common voltage Vcom is applied to the common electrode. Hereinafter, an absolute value of the electrical potential difference between the data voltage Vd and the common voltage Vcom is referred to as a pixel voltage. An end of the storage capacitor Cst is connected to the pixel electrode Pe, and another end of the storage capacitor Cst is connected to a storage electrode (not shown). An electrical potential difference between the data voltage Vd and a storage voltage Vst is charged in the storage capacitor Cst, wherein the data voltage Vd is applied to the pixel electrode Pe and the storage voltage Vst is applied to the storage electrode.

In order to drive the electrophoresis display device or the cholesteric liquid crystal display device, the pixel voltage is required to be equal to or greater than 30V, and in order to reset the electrophoresis display device or the cholesteric liquid crystal display device, the pixel voltage is required to be equal to or greater than 40V. As a result, in a driving operation according to the related art, the data voltage Vd and the common voltage Vcom applied to the electrophoresis display device or the cholesteric liquid crystal display device are equal to or greater than 40V. Thus, when the polarity of the common voltage Vcom is reversed, a voltage equal to or greater than 40V is applied to the pixel electrode Pe, and as a result, the TFT having a withstand voltage equal to or less than 20V is damaged. Accordingly, in a case where the data voltage Vd is equal to or less than 20V, a driving method in which a high withstand voltage equal to or greater than 30V is applied to a pixel, without damaging the TFT, is necessary. For the driving method, according to one or more embodiments of the present invention, a pre-discharging period and a discharging period are arranged after a pixel is charged, and the polarity of the common voltage Vcom is reversed in the discharging period. If the data voltage Vd exceeds 50% of the pixel voltage, the discharging period is arranged without the pre-discharging period, and then the polarity of the common voltage Vcom is reversed in the discharging period. Accordingly, a gate-drain voltage Vgd of the TFT may be decreased to ±20V.

Figure 3:
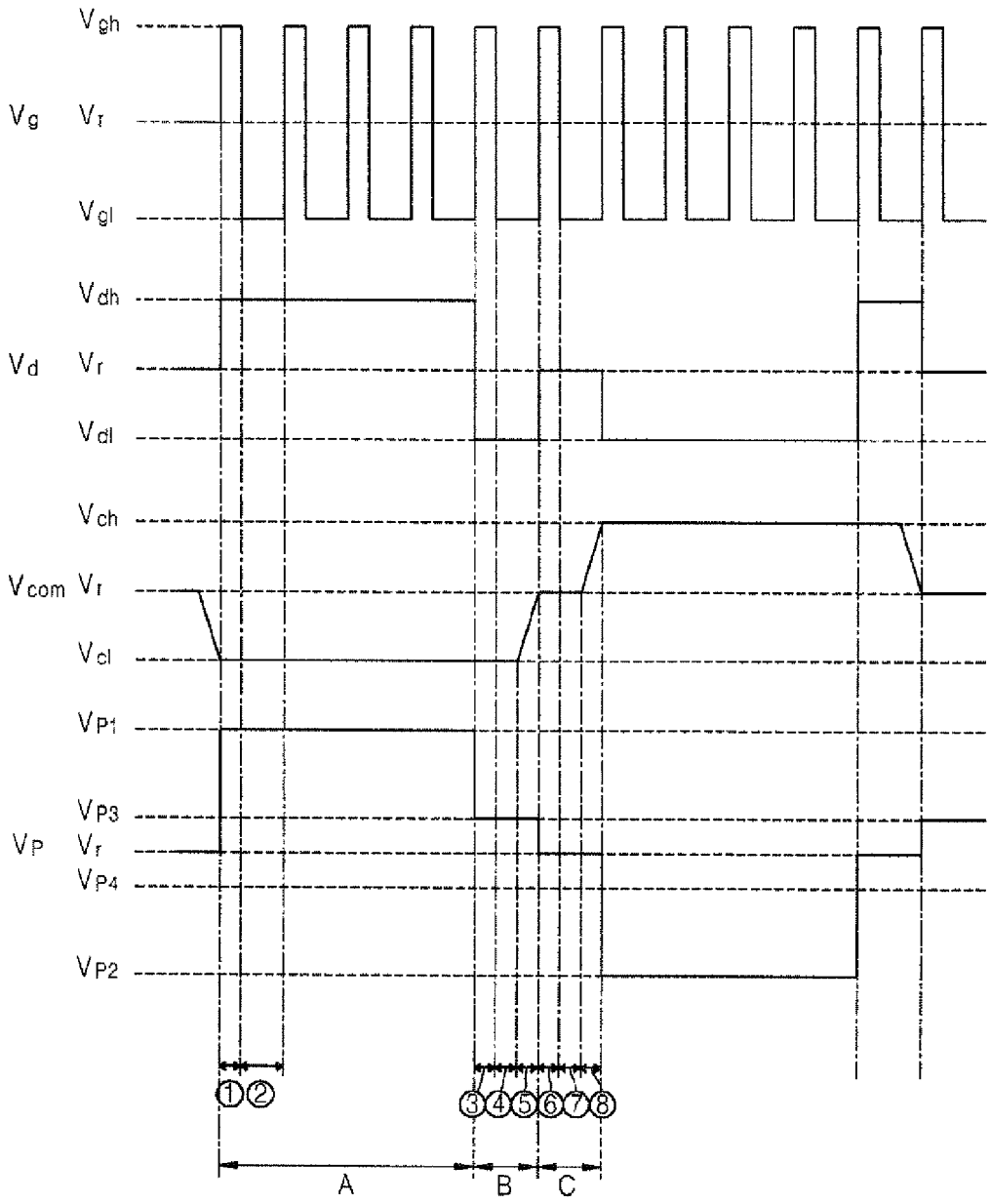
FIG. 3 is a timing diagram for describing reset driving of a display device according to an embodiment of the present invention.
Figure 4:
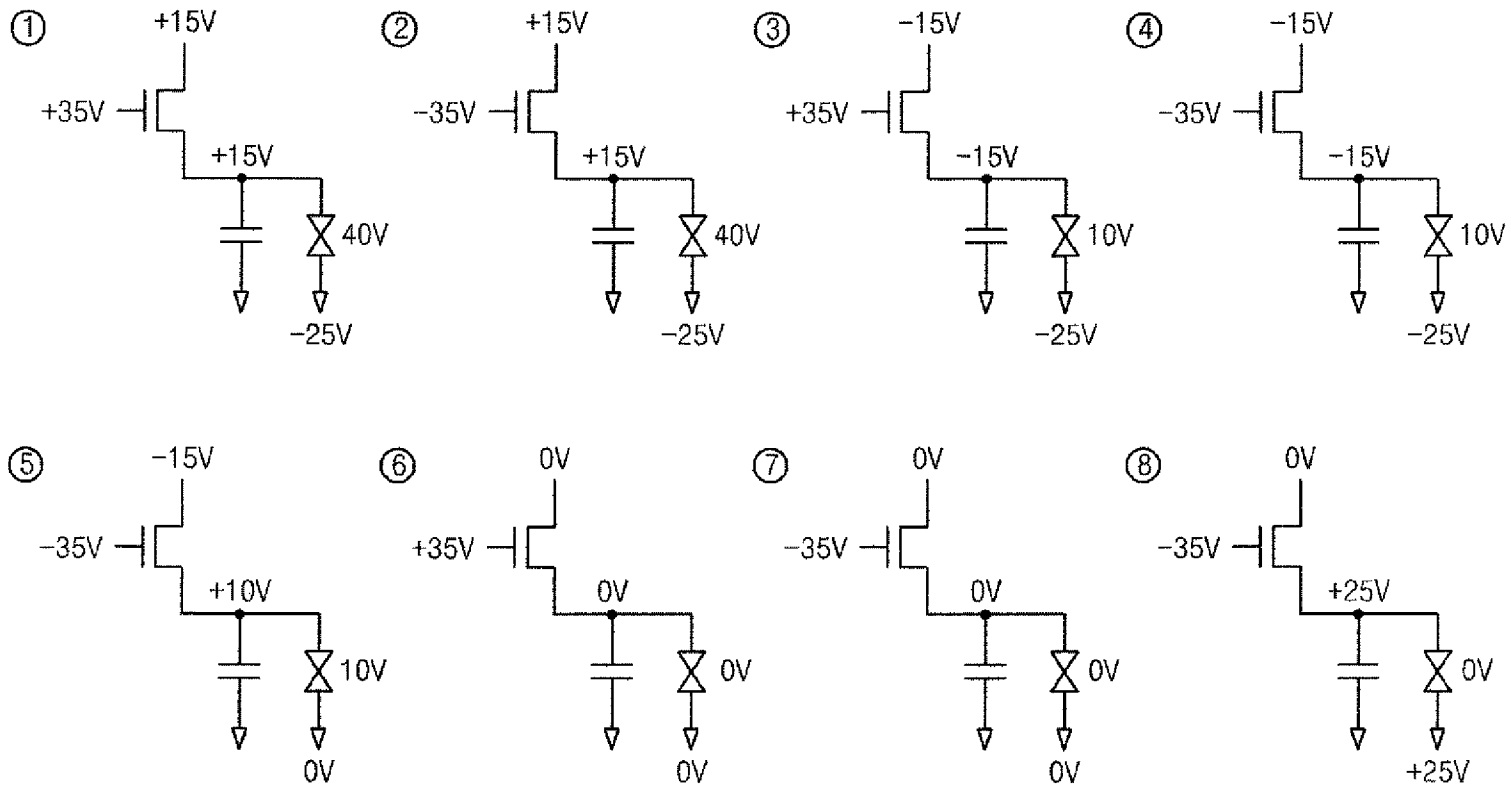
FIG. 4 illustrates reset driving of a pixel to which the timing diagram of FIG. 3 is applied.

FIG. 3 is a timing diagram for describing reset driving of a display device according to an embodiment of the present invention, and FIG. 4 illustrates reset driving of a pixel to which the timing diagram of FIG. 3 is applied.

When displaying on a screen starts, an electrophoresis display device performs a resetting operation so as to make an entire screen black or white. A cholesteric liquid crystal display device performs a resetting operation so as to change a mixed state, including a planar state and a focal conic state, to a homeotropic state. For the resetting operations, a high pixel voltage Vp of about 40V is necessary.

Referring to FIG. 3, in a charging period A, the pixel voltage Vp is charged in a display cell Clc by a data voltage Vd and a common voltage Vcom. The charged pixel voltage Vp is discharged in a pre-discharging period B and a discharging period C. The polarity of the common voltage Vcom is reversed in periods corresponding to the pre-discharging period B and the discharging period C. This is to prevent a case in which a voltage of a pixel electrode is increased due to the reversal of the polarity of the common voltage Vcom, and thus to prevent a switching device from being damaged.

A gate voltage Vg has an alternating current (AC) pulse form or a dual-polarity form. The gate voltage Vg is repeatedly applied at regular intervals. With respect to a reference voltage Vr, the gate voltage Vg swings between a gate-on voltage Vgh at a high level and a gate-OFF voltage Vg1 at a low level.

As the data voltage Vd, a data voltage Vdh having positive polarity and a data voltage Vd1 having negative polarity are alternately outputted with respect to the reference voltage Vr. A voltage level of the data voltage Vd is changed in a period in which its polarity is reversed. The data voltage Vd has the same polarity as the common voltage Vcom in the pre-discharging period B, and outputs the reference voltage Vr in the discharging period C.

As the common voltage Vcom, a common voltage Vch having positive polarity and a common voltage Vc1 having negative polarity are alternately outputted with respect to the reference voltage Vr. A voltage level of the common voltage Vcom is gradually changed in a period in which its polarity is reversed.

The pixel voltage Vp corresponds to an absolute value of an electrical potential difference between the data voltage Vd and the common voltage Vcom. According to the polarities and the levels of the common voltage Vcom and the data voltage Vd, the pixel voltage Vp has an electrical potential difference Vp1 at a high level or an electrical potential difference Vp2 at a low level in the charging period A, and has an electrical potential difference Vp3 at a high level or an electrical potential difference Vp4 at a low level in the pre-discharging period B. By gradually decreasing the pixel voltage Vp via the pre-discharging period B and the discharging period C, and by reversing the polarity of the common voltage Vcom, it is possible to prevent a case in which the switching device is damaged by a high withstand voltage when the common voltage Vcom is reversed.

For example, the data voltage Vd is applied to each pixel while the pixel voltage Vp swings between ±15V or ±20V, and the common voltage Vcom is applied to each pixel while the common voltage Vcom swings between ±25V or ±20V, so that the high pixel voltage Vp of 40V for the reset driving may be charged. Hereinafter, an example in which the pixel voltage Vp of 40V is charged will now be described with reference to FIGS. 3 and 4.

Referring to FIGS. 3 and 4, each pixel has applied to it a gate voltage Vg output as a gate-on voltage Vgh of +35V and a gate-off voltage Vg1 of −35V alternately, a data voltage Vd output as a data voltage Vdh of +15V having positive polarity and a data voltage Vd1 of −15V having negative polarity alternately, and a common voltage Vcom output as a common voltage Vch of +25V having positive polarity and a common voltage Vc1 of −25V having negative polarity alternately. A reference voltage Vr is 0V.

The charging period A includes a period ① and a period ②, the pre-discharging period B includes periods ③ thru ⑤, and the discharging period C includes periods ⑥ thru ⑧.

In the period ①, the data voltage Vdh of +15V is applied to a pixel electrode which is electrically connected to an end of a display cell Clc via a transistor which is turned on by an applied gate-on voltage Vgh of +35V. The common voltage Vc1 of −25V is applied to another end of the display cell Clc. Thus, an electrical potential difference Vp1 of +40V is generated across the display cell Clc, and therefore a pixel voltage Vp of about 40V is charged.

In the period ②, the gate-off voltage Vg1 of −35V is applied to the transistor, and thus the transistor is turned off. The common voltage Vc1 of −25V is applied to the other end of the display cell Clc. Thus, the electrical potential difference Vp1 of +40V between the data voltage Vdh of +15V applied during the period ③ and the common voltage Vc1 of −25V is generated across the display cell Clc, and therefore the pixel voltage Vp of 40V is charged.

The charging operations in the period ① and the period ② are repeated a plurality of times.

In the period ④, the data voltage Vd1 of −15V is applied to the pixel electrode electrically connected to the end of the display cell Clc via the transistor which is turned on by having the gate-on voltage Vgh of +35V applied thereto. The common voltage Vc1 of −25V is applied to the other end of the display cell Clc. Thus, an electrical potential difference Vp3 of +10V is generated across the display cell Clc, and therefore a pixel voltage of 10V is outputted. Due to the pre-discharging in the period ③, the pixel voltage Vp of 40V is decreased to 10V.

In the period ④, the gate-off voltage Vg1 of −35V is applied to the transistor, and thus the transistor is turned off. The common voltage Vc1 of −25V is applied to the other end of the display cell Clc. Thus, the display cell Clc maintains the pixel voltage Vp of 10V due to the data voltage Vd1 of −15V applied during the period ③ and the common voltage Vc1 of −25V, and outputs the pixel voltage Vp of 10V.

In the period ⑤, the gate-off voltage Vg1 of −35V is maintained, and the transistor remains in a turned-off status. As the common voltage Vcom, the reference voltage Vr of 0V is applied to the other end of the display cell Clc. The display cell Clc maintains and outputs the pixel voltage Vp of 10V, and thus the voltage of the pixel electrode is +10V.

In the period ⑥, as the data voltage Vd, the reference voltage Vr of 0V is applied to the pixel electrode electrically connected to the end of the display cell Clc via the transistor which is turned on by having the gate-on voltage Vgh of +35V applied thereto. As the common voltage Vcom, the reference voltage Vr of 0V is applied to the other end of the display cell Clc. Thus, the display cell Clc outputs 0V as the pixel voltage Vp. Due to the discharging in the period ⑥, the pixel voltage Vp of 10V is decreased to 0V.

In the period ⑦, the gate-off voltage Vg1 of −35V is applied to the transistor, and thus the transistor is turned off. As the common voltage Vcom, the reference voltage Vr of −0V is applied to the other end of the display cell Clc. The display cell Clc maintains and outputs the pixel voltage Vp of 0V, and thus the voltage of the pixel electrode is 0V.

In the period ⑧, the gate-off voltage Vg1 of −35V is applied to the transistor, and thus the transistor remains in the turned-off status. After the pixel voltage Vp is changed to 0V, the polarity of the common voltage Vcom is reversed, and thus a first common voltage Vc1 of +25V is applied to the other end of the display cell Clc. The display cell Clc maintains and outputs the pixel voltage Vp of 0V, and thus the voltage of the pixel electrode is +25V.

The operations in the periods ① through ⑧ are similarly applied to a case in which the polarity of the data voltage Vd and the polarity of the common voltage Vcom are reversed, and in this case, the polarity of the electrical potential difference across the display cell Clc is also reversed.

The pixel voltage Vp of 40V charged in the charging period A is first decreased to 10V by the data voltage Vd and the common voltage Vcom having the same polarity as each other in the pre-discharging period B, and is then decreased to 0V by the data voltage Vd and the common voltage Vcom of 0V in the discharging period C. After the pixel voltage Vp is changed to 0V, if the polarity of the common voltage Vcom is reversed, the voltage applied to the pixel electrode may be limited to a maximum voltage of ±25V. Accordingly, it is possible to prevent a case in which a switching device is damaged due to an increase in voltage applied to a pixel electrode when the polarity of the common voltage Vcom is reversed.

Figure 5:
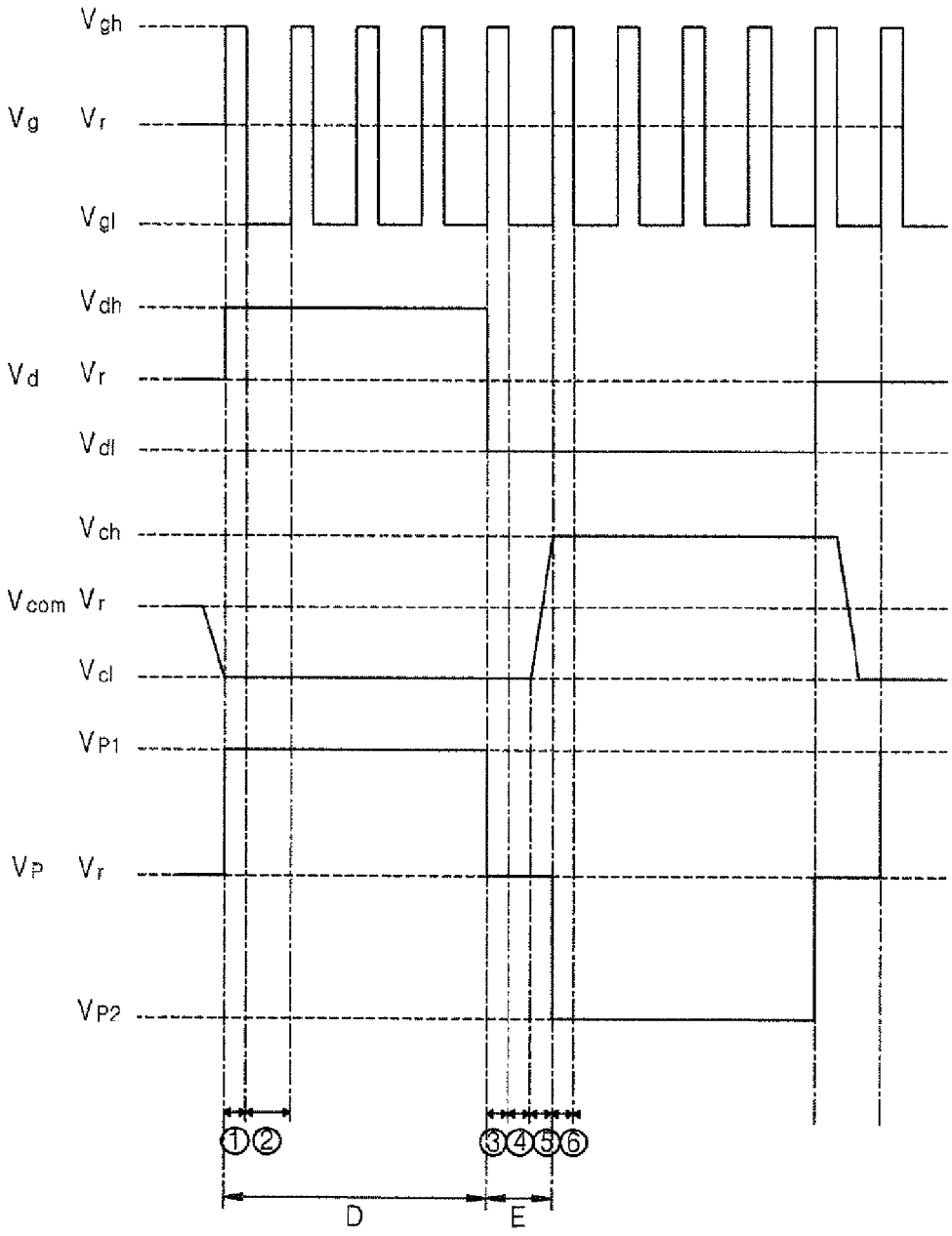
FIG. 5 is a timing diagram for describing selective driving for grayscale expression of a display device according to an embodiment of the present invention.
Figure 6:
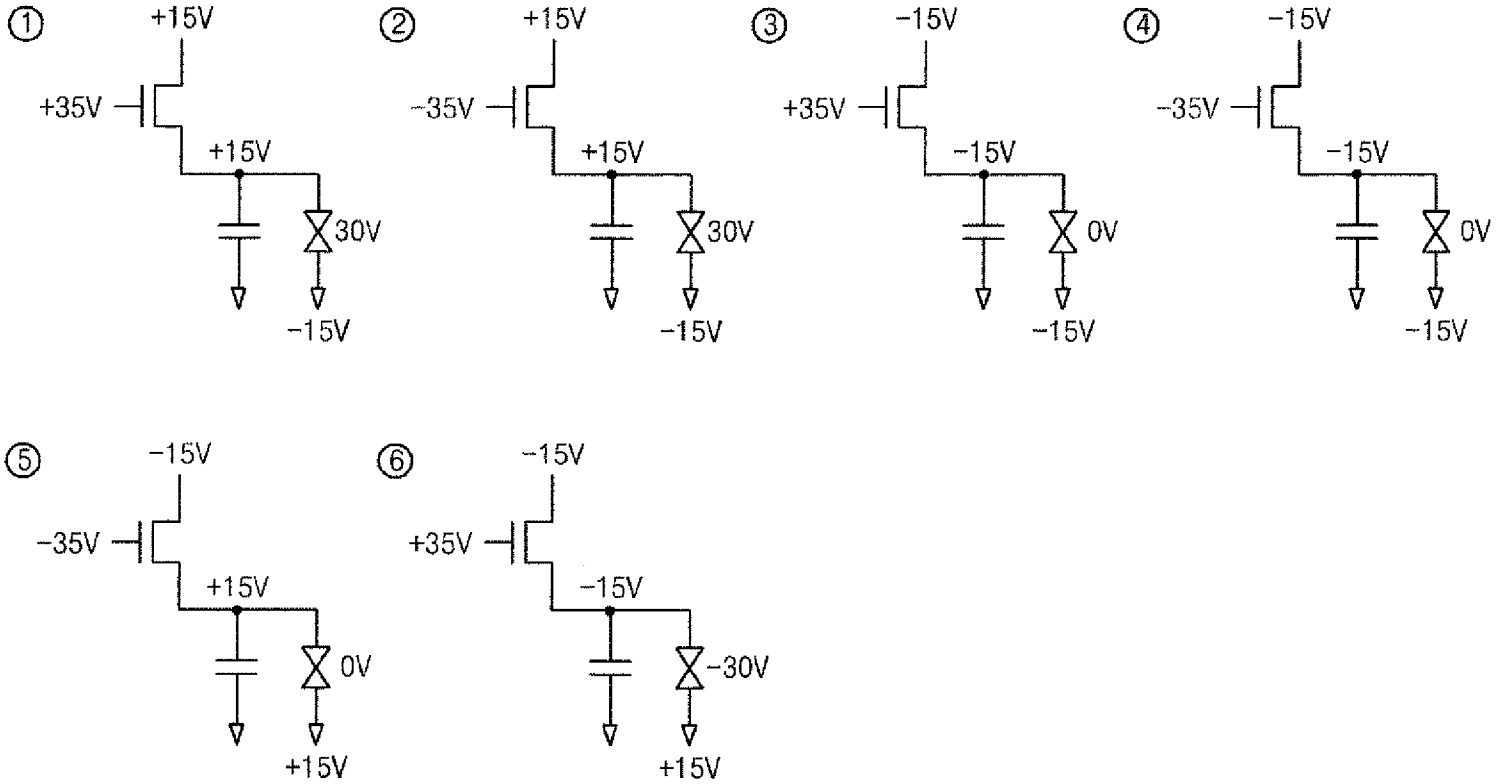
FIG. 6 illustrates selective driving of a pixel to which the timing diagram of FIG. 5 is applied.

FIG. 5 is a timing diagram for describing selective driving for grayscale expression of a display device according to an embodiment of the present invention, and FIG. 6 illustrates selective driving of a pixel to which the timing diagram of FIG. 5 is applied.

An electrophoresis display device and a cholesteric liquid crystal display device may express a plurality of grayscale levels (gray levels) by controlling a pixel voltage. The grayscale levels may be controlled by a pulse amplitude modulation (PAM) method and/or a pulse width modulation (PWM) method, wherein the PAM method involves appropriately changing a level of the pixel voltage, and the PWM method involves appropriately changing an application time of the pixel voltage. Also, the grayscale levels may be expressed by adjusting the number of times in which a short pulse of the pixel voltage is applied.

When a voltage of about 30V is applied to the cholesteric liquid crystal display device, a homeotropic status is changed to a planar status, and a reflectance is changed according to the level of an applied voltage (voltage pulse amplitude) and the application time (a voltage pulse width). The reflectance corresponds to a predetermined grayscale level.

Referring to FIG. 5, in a charging period D, a pixel voltage Vp corresponding to an absolute value of an electrical potential difference between a data voltage Vd and a common voltage Vcom is charged in a display cell Clc. A period for reversal of polarity of the common voltage Vcom includes a discharging period E without a pre-discharging period. Since the pixel voltage Vp is a lower in the grayscale expression than in a reset operation, it is possible to omit the pre-discharging period. The discharging period E is arranged to prevent a case in which a voltage of a pixel electrode is increased due to the reversal of polarity of the common voltage Vcom, and thus to prevent a switching device from being damaged.

A gate voltage Vg has an AC pulse form or a dual-polarity form. The gate voltage Vg is repeatedly applied at regular intervals. With respect to a reference voltage Vr, the gate voltage Vg swings between a gate-on voltage Vgh and a gate-OFF voltage Vg1.

As the data voltage Vd, a data voltage Vdh having positive polarity and a data voltage Vd1 having negative polarity are alternately outputted with respect to the reference voltage Vr. A voltage level of the data voltage Vd is changed in a period in which its polarity is reversed. The data voltage Vd has the same polarity as the common voltage Vcom in the discharging period E. In the discharging period E, voltages applied to both the data voltage Vd and the common voltage Vcom may be at the same level, e.g., 0V.

As the common voltage Vcom, a common voltage Vch having positive polarity and a common voltage Vc1 having negative polarity are alternately outputted with respect to the reference voltage Vr.

The pixel voltage Vp corresponds to the absolute value of the electrical potential difference between the data voltage Vd and the common voltage Vcom. According to the polarities and the levels of the common voltage Vcom and the data voltage Vd, the pixel voltage Vp has an electrical potential difference Vp1 at a high level or an electrical potential difference Vp2 at a low level in the charging period D. By decreasing the pixel voltage Vp in the discharging period E, and then by reversing the polarity of the common voltage Vcom, it is possible to prevent a case in which the switching device is damaged by a high withstand voltage when the common voltage Vcom is reversed.

For example, the data voltage Vd is applied to each pixel while the pixel voltage Vp swings between ±15V, and the common voltage Vcom is applied to each pixel while the common voltage Vcom swings between ±20V, and thus the pixel voltage Vp of 30V may be charged. Hereinafter, an example in which the pixel voltage Vp of 30V is charged will be described with reference to FIGS. 5 and 6.

Referring to FIGS. 5 and 6, each pixel has applied to it a gate voltage Vg output as a gate-on voltage Vgh of +35V and a gate-off voltage Vg1 of −35V alternately, a data voltage Vd output as a data voltage Vdh of +15V and a data voltage Vd1 of −15V alternately, and a common voltage Vcom output as a common voltage Vch of +15V and a common voltage Vc1 of −15V alternately. A reference voltage Vr is 0V.

The charging period D includes a period ① and a period ②, and the discharging period E includes periods ③ thru ⑤.

In the period ①, the data voltage Vdh of +15V is applied to a pixel electrode which is electrically connected to an end of the display cell Clc via a transistor which is turned on by the gate-on voltage Vgh of +35V applied to it. The common voltage Vc1 of −15V is applied to another end of the display cell Clc. Thus, an electrical potential difference Vp1 of +30V is generated across the display cell Clc, and therefore the pixel voltage Vp of about 30V is charged.

In the period ②, the gate-off voltage Vg1 of −35V is applied to the transistor, and thus the transistor is turned off. The common voltage Vc1 of −15V is applied to the other end of the display cell Clc. Thus, the electrical potential difference Vp1 of +30V due to the data voltage Vdh of +15V and the common voltage Vc1 of −15V applied during the period ① is generated across the display cell Clc, and therefore the pixel voltage Vp of 30V is charged.

The charging operations in the period ① and the period ② are repeated a plurality of times.

In the period ③, the data voltage Vd1 of −15V is applied to the pixel electrode electrically connected to the end of the display cell Clc via the transistor which is turned on by the gate-on voltage Vgh of +35V applied to it. The common voltage Vc1 of −15V is applied to the other end of the display cell Clc. Due to the discharging in the period ③, the pixel voltage Vp is decreased from 30V to 0V.

In the period CD, the gate-off voltage Vg1 of −35V is applied to the transistor, and thus the transistor is turned off. The common voltage Vc1 of −15V is applied to the other end of the display cell Clc. Thus, the display cell Clc maintains the pixel voltage Vp of 0V due to the data voltage Vd1 of −15V applied during the period ③ and the common voltage Vc1 of −15V, and outputs the pixel voltage Vp of 0V.

In the period ⑤, the gate-off voltage Vg1 of −35V is applied to the transistor, and thus the transistor remains in the turned-off status. After the pixel voltage Vp is changed to 0V, the polarity of the common voltage Vcom is reversed, and thus a common voltage Vch of +15V is applied to the other end of the display cell Clc. The display cell Clc maintains and outputs the pixel voltage Vp of 0V, and thus the voltage of the pixel electrode is +15V.

In the period ⑥, the data voltage Vdh of −15V is applied to the pixel electrode electrically connected to the end of the display cell Clc via the transistor which is turned on by the gate-on voltage Vgh of +35V applied to it. The common voltage Vc1 of +15V is applied to the other end of the display cell Clc. Thus, an electrical potential difference Vp2 of −30V is generated across the display cell Clc, and therefore the pixel voltage Vp of 30V is charged.

The operations in the periods ① through ⑥ are similarly applied to a case in which the polarity of the data voltage Vd and the polarity of the common voltage Vcom are reversed, and in this case, the polarity of the electrical potential difference across the display cell Clc is also reversed.

The pixel voltage Vp of 30V charged in the charging period D is decreased to 0V by the data voltage Vd and the common voltage Vcom having the same polarity in the discharging period E. After the pixel voltage Vp is changed to 0V, if the polarity of the common voltage Vcom is reversed, the voltage applied to the pixel electrode may be limited to a maximum voltage of ±15V. Accordingly, it is possible to prevent a case in which a switching device is damaged due to an increase in voltage applied to a pixel electrode when the polarity of the common voltage Vcom is reversed.

FIGS. 5 and 6 are related to the pixel voltage Vp for the grayscale expression. However, in a case wherein a pixel voltage Vp for reset driving is a pixel voltage Vp for the grayscale expression (for example, lower than 30 V), a period for reversal of polarity of the common voltage Vcom may also include a discharging period without a pre-discharging period, as illustrated in FIG. 5. Also, in a case where the data voltage Vd approaches 50% of the pixel voltage Vp, although the pixel voltage Vp is greater than the pixel voltage Vp for the grayscale expression (for example, 30 V), the period for the reversal of polarity of the common voltage Vcom may also include the discharging period without the pre-discharging period, as illustrated in FIG. 5.

Figure 7:
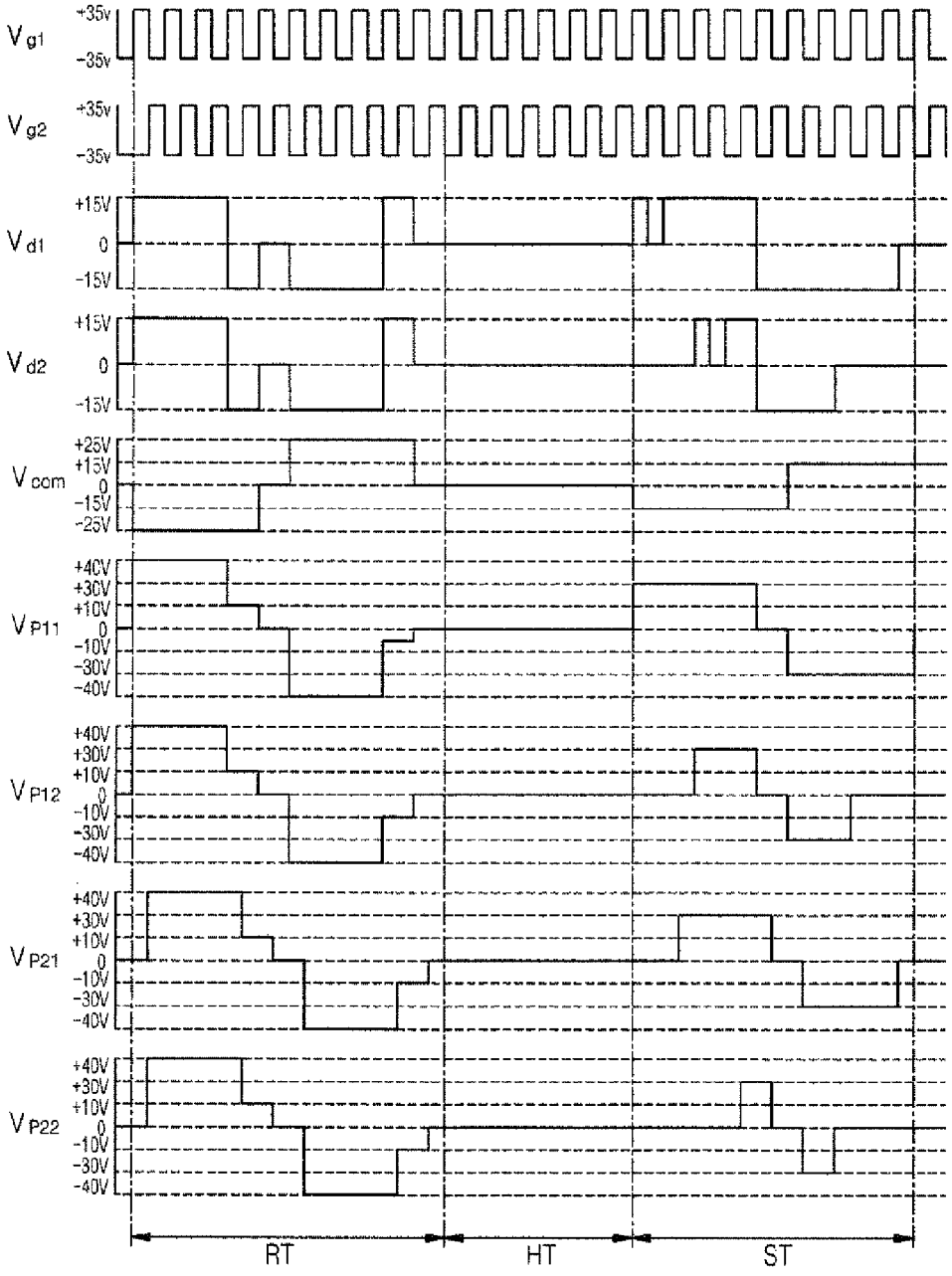
FIG. 7 is a timing diagram for describing a method of driving a display device according to an embodiment of the present invention.
Figure 8:
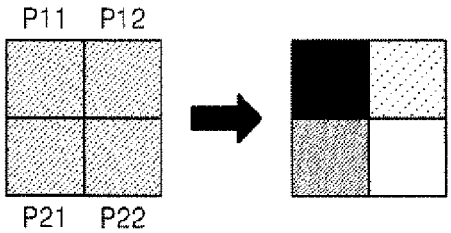
FIG. 8 illustrates a grayscale of each pixel of FIG. 7.

FIG. 7 is a timing diagram for describing a method of driving a display device according to an embodiment of the present invention, and FIG. 8 illustrates a grayscale of each pixel of FIG. 7. The display device includes an electrophoresis display device and a cholesteric liquid crystal display device.

The method of FIG. 7 relates to a case wherein the display device is driven by using a data voltage Vd of ±15V and a common voltage Vcom of ±25V when a pixel voltage Vp for reset is required to be 40V and the pixel voltage Vp for grayscale expression is required to be 30V. The pixel voltage Vp is indicated as an absolute value.

Referring to FIG. 7, the display device is driven according to an order of a reset time RT, a holding time HT, and a selection time ST for expression of a grayscale. The grayscale varies according to a pulse width of the pixel voltage Vp.

In the reset time RT, after the pixel voltage Vp is charged, the pixel voltage Vp is gradually discharged via a first discharging period and a second discharging period. In the second discharging period, the pixel voltage Vp is changed to 0V. In the discharging period, the polarity of the common voltage Vcom is increased or decreased in a step-wise manner, and is reversed after the pixel voltage Vp is changed to 0V. The data voltage Vd and the common voltage Vcom have periods in which their polarities are the same, wherein the periods correspond to the first discharging period of the pixel voltage Vp. Also, the data voltage Vd and the common voltage Vcom have periods in which the data voltage Vd and the common voltage Vcom are 0V, wherein the periods correspond to the second discharging period of the pixel voltage Vp.

In the holding time HT, the data voltage Vd and the common voltage Vcom are not changed. In the selection time ST, the pixel voltage Vp is charged and then discharged once. The data voltage Vd and the common voltage Vcom have periods in which their polarities are the same in the periods corresponding to a discharging period of the pixel voltage Vp.

The case of FIG. 7 relates to driving of first thru fourth pixels P11, P12, P21, and P22 formed in a 2×2 matrix, and formed by a first gate electrode line and a second gate electrode line and a first source electrode line and a second source electrode line. However, the present embodiment is not limited to this case, and thus it may be equally applied to driving of five or more pixels.

The first pixel P11 is connected to the first gate electrode line and the first source electrode line, and is turned on by a first gate voltage Vg1. The second pixel P12 is connected to the first gate electrode line and a second data electrode line, and is turned on by the first gate voltage Vg1. The third pixel P21 is connected to the second gate electrode line and a first data electrode line, and is turned on by a second gate voltage Vg2. The fourth pixel P22 is connected to the second gate electrode line and the second data electrode line, and is turned on by the second gate voltage Vg2.

The first gate voltage Vg1 is applied to the first gate electrode line and the second gate voltage Vg2 is applied to the second gate electrode line sequentially, and alternately output a voltage of +35V for turning on a switching device and a voltage of −35V for turning off the switching device. A first data voltage Vd1 is applied to the first source electrode line and a second data voltage Vd2 is applied to the second source electrode line and alternately output a voltage of +15V and a voltage of −15V. The common voltage Vcom alternately outputs a voltage of +25V and a voltage of −25V in the reset time RT, and alternately outputs a voltage of +15V and a voltage of −15V in the selection time ST.

In the reset time RT, the first pixel P11 is reset by a pixel voltage Vp11 of 40V charged by the first data voltage Vd1 of ±15V and the common voltage Vcom of ±25V. An electrical potential difference of +40V is formed in a display cell Clc due to the first data voltage Vd1 of +15V and the common voltage Vcom of −25V, and thus the pixel voltage Vp11 of 40V is charged. Afterward, the pixel voltage Vp11 is first discharged to 10V by the first data voltage Vd1 of −15V and the common voltage Vcom of −25V. Then, the pixel voltage Vp1 is discharged to 0V by the first data voltage Vd1 of 0V and the common voltage Vcom of 0V. Afterward, an electrical potential difference of −40V is formed in the display cell Clc due to the first data voltage Vd1 of −15V and the common voltage Vcom of +25V, and thus the pixel voltage Vp11 of 40V is charged.

In the selection time ST, the first pixel P11 expresses a grayscale according to a pulse width of the pixel voltage Vp11 of 30V charged by the first data voltage Vd1 of ±15V and the common voltage Vcom of ±15V. The pixel voltage Vp11 of 30V is charged in the display cell Clc by the first data voltage Vd1 of +15V and the common voltage Vcom of −15V. Afterward, the pixel voltage Vp11 is discharged to 0V by the first data voltage Vd1 of −15V and the common voltage Vcom of −15V. Then, the pixel voltage Vp11 of 30V is charged in the display cell Clc by the first data voltage Vd1 of −15V and the common voltage Vcom of +15V.

In the reset time RT, the second pixel P12 is reset by a pixel voltage Vp12 of 40V charged by the second data voltage Vd2 of ±15V and the common voltage Vcom of ±25V. The pixel voltage Vp12 of 40V is charged in the display cell Clc by the second data voltage Vd2 of +15V and the common voltage Vcom of −25V. Afterward, the pixel voltage Vp12 of 40V is first discharged to 10V by the second data voltage Vd2 of −15V and the common voltage Vcom of −25V. Then, the pixel voltage Vp12 of 10V is discharged to 0V by the second data voltage Vd2 of 0V and the common voltage Vcom of 0V. Afterward, the pixel voltage Vp12 of 40V is charged in the display cell Clc by the second data voltage Vd2 of −15V and the common voltage Vcom of +25V.

In the selection time ST, the second pixel P12 expresses a grayscale according to a pulse width of the pixel voltage Vp12 of 30V charged by the second data voltage Vd2 of ±15V and the common voltage Vcom of ±15V. The pixel voltage Vp12 of 30V is charged in the display cell Clc by the second data voltage Vd2 of +15V and the common voltage Vcom of −15V. Afterward, the pixel voltage Vp12 of 30V is discharged to 0V by the second data voltage Vd2 of −15V and the common voltage Vcom of −15V. Then, the pixel voltage Vp12 of 30V is charged in the display cell Clc by the second data voltage Vd2 of −15V and the common voltage Vcom of +15V.

In the reset time RT, the third pixel P21 is reset by a pixel voltage Vp21 of 40V charged by the first data voltage Vd1 of ±15V and the common voltage Vcom of ±25V. The pixel voltage Vp21 of 40V is charged in the display cell Clc by the first data voltage Vd1 of +15V and the common voltage Vcom of −25V. Afterward, the pixel voltage Vp21 of 40V is first discharged to 10V by the first data voltage Vd1 of −15V and the common voltage Vcom of −25V. Then, the pixel voltage Vp21 of 10V is discharged to 0V by the first data voltage Vd1 of 0V and the common voltage Vcom of 0V. Afterward, the pixel voltage Vp21 of 40V is charged in the display cell Clc by the first data voltage Vd1 of −15V and the common voltage Vcom of +25V.

In the selection time ST, the third pixel P21 expresses a grayscale according to a pulse width of the pixel voltage Vp21 of 30V charged by the first data voltage Vd1 of ±15V and the common voltage Vcom of ±15V. The pixel voltage Vp21 of 30V is charged in the display cell Clc by the first data voltage Vd1 of +15V and the common voltage Vcom of −15V. Afterward, the pixel voltage Vp21 is discharged to 0V by the first data voltage Vd1 of −15V and the common voltage Vcom of −15V. Then, the pixel voltage Vp21 of 30V is charged in the display cell Clc by the first data voltage Vd1 of −15V and the common voltage Vcom of +15V.

In the reset time RT, the fourth pixel P22 is reset by a pixel voltage Vp22 of 40V charged by the second data voltage Vd2 of ±15V and the common voltage Vcom of ±25V. The pixel voltage Vp22 of 40V is charged in the display cell Clc by the second data voltage Vd2 of +15V and the common voltage Vcom of −25V. Afterward, the pixel voltage Vp22 of 40V is first discharged to 10V by the second data voltage Vd2 of −15V and the common voltage Vcom of −25V. Then, the pixel voltage Vp22 of 10V is discharged to 0V by the second data voltage Vd2 of 0V and the common voltage Vcom of 0V. Afterward, the pixel voltage Vp22 of 40V is charged in the display cell Clc by the second data voltage Vd2 of −15V and the common voltage Vcom of +25V.

In the selection time ST, the fourth pixel P22 expresses a grayscale according to a pulse width of the pixel voltage Vp22 of 30V charged by the second data voltage Vd2 of ±15V and the common voltage Vcom of ±15V. The pixel voltage Vp22 of 30V is charged in the display cell Clc by the second data voltage Vd2 of +15V and the common voltage Vcom of −15V. Afterward, the pixel voltage Vp22 is discharged to 0V by the second data voltage Vd2 of −15V and the common voltage Vcom of −15V. Then, the pixel voltage Vp22 of 30V is charged in the display cell Clc by the second data voltage Vd2 of −15V and the common voltage Vcom of +15V.

In the selection time ST, the pulse widths of the pixel voltages Vp become narrow in an order of the pixel voltage Vp11, the pixel voltage Vp21, the pixel voltage Vp12, and the pixel voltage Vp22. Thus, as illustrated in FIG. 8, the grayscales are dimmed in an order of the first pixel P11, the third pixel P21, the second pixel P12, and the fourth pixel P22.

According to the embodiment of FIG. 7, it is possible to generate the pixel voltages Vp of 40V and 30V by using the data voltage Vd of ±15 V without damaging the switching device.

Figure 9:
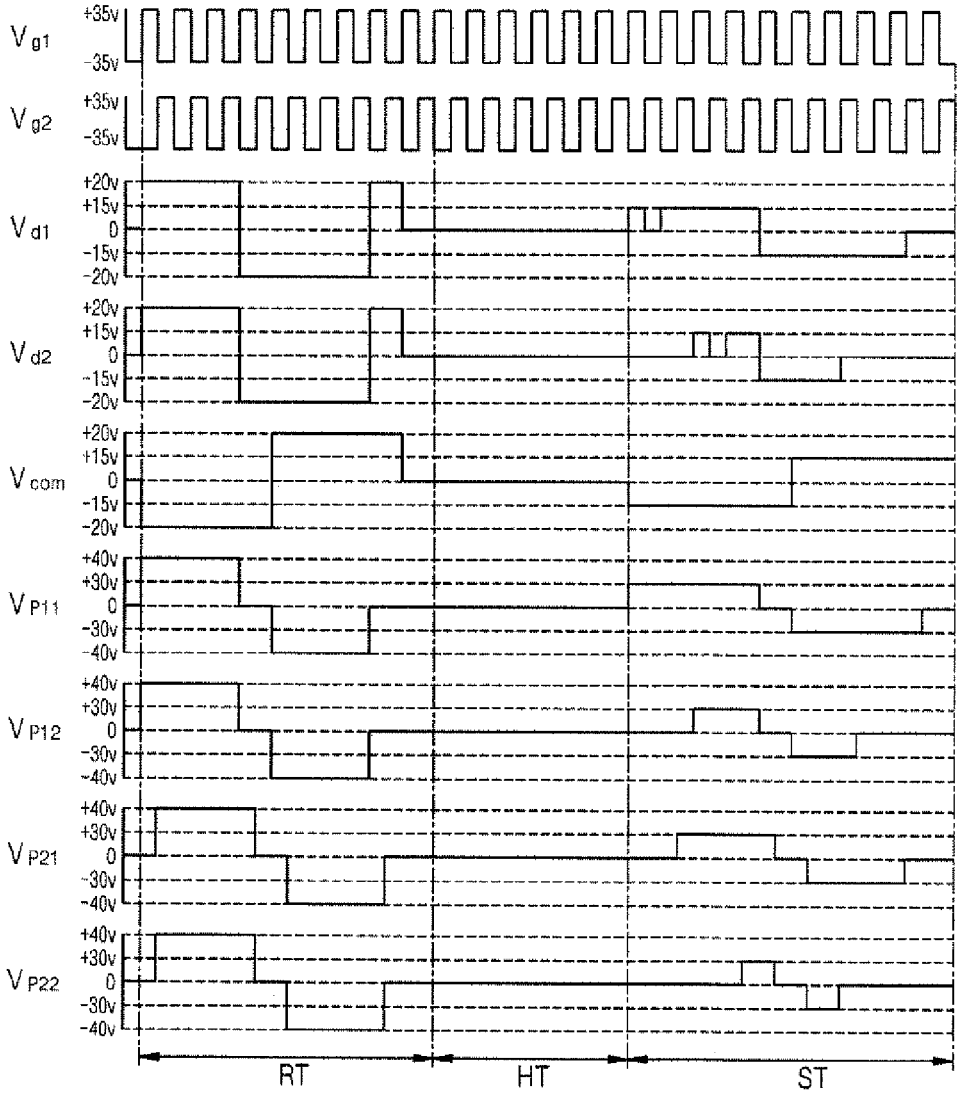
FIG. 9 is a timing diagram for describing a method of driving a display device according to another embodiment of the present invention.

FIG. 9 is a timing diagram for describing a method of driving a display device according to another embodiment of the present invention. The display device includes an electrophoresis display device and a cholesteric liquid crystal display device.

The method of FIG. 9 is related to a case where the display device is driven by using a data voltage Vd of ±20V and ±15V and a common voltage Vcom of ±20V and ±15V, when a pixel voltage Vp for reset is required to be 40V and the pixel voltage Vp for grayscale expression is required to be 30V, and the data voltage Vd reaches 50% of the pixel voltage Vp for reset. In the present embodiment, the data voltage Vd is available up to 20V.

Referring to FIG. 9, the display device is driven according to an order of a reset time RT, a holding time HT, and a selection time ST for expression of a grayscale. The grayscale varies according to a pulse width of the pixel voltage Vp.

In the reset time RT, after the pixel voltage Vp is charged, the pixel voltage Vp is discharged without a pre-discharging period.

In the discharging period, the pixel voltage Vp is changed to 0V. The data voltage Vd and the common voltage Vcom have periods in which their polarities are the same in the periods corresponding to the discharging period of the pixel voltage Vp.

In the holding time HT, the data voltage Vd and the common voltage Vcom are not changed. In the selection time ST, after the pixel voltage Vp is charged, the pixel voltage Vp is discharged.

When the pixel voltage Vp is discharged, the data voltage Vd and the common voltage Vcom have periods in which their polarities are the same.

The embodiment of FIG. 9 is the same as the embodiment of FIG. 7 except that, in the embodiment of FIG. 9, the discharging is performed without the pre-discharging period in the reset time RT, and the pixel voltage Vp is generated by the data voltage Vd of ±20V and the common voltage Vcom of ±20V. Thus, detailed descriptions which are the same as previously mentioned will be omitted.

In the reset time RT, a first pixel P11 is reset by a pixel voltage Vp11 of 40V charged by the first data voltage Vd1 of ±20V and the common voltage Vcom of ±20V. The pixel voltage Vp11 of 40V is charged in a display cell Clc by the first data voltage Vd1 of +20V and the common voltage Vcom of −20V. Afterward, the pixel voltage Vp11 of 40V is discharged to 0V by the first data voltage Vd1 of −20V and the common voltage Vcom of −20V. Afterward, the pixel voltage Vp11 of 40V is charged in the display cell Clc by the first data voltage Vd1 of −20V and the common voltage Vcom of +20V.

In the reset time RT, a second pixel P12 is reset by a pixel voltage Vp12 of 40V charged by the second data voltage Vd2 of ±20V and the common voltage Vcom of ±20V. The pixel voltage Vp12 of 40V is charged in the display cell Clc by the second data voltage Vd2 of +20V and the common voltage Vcom of −20V. Afterward, the pixel voltage Vp12 of 40V is discharged to 0V by the second data voltage Vd2 of −20V and the common voltage Vcom of −20V. Afterward, the pixel voltage Vp12 of 40V is charged in the display cell Clc by the second data voltage Vd2 of −20V and the common voltage Vcom of +20V.

In the reset time RT, a third pixel P21 is reset by a pixel voltage Vp21 of 40V charged by the first data voltage Vd1 of ±20V and the common voltage Vcom of ±20V. The pixel voltage Vp21 of 40V is charged in the display cell Clc by the first data voltage Vd1 of +20V and the common voltage Vcom of −20V. Afterward, the pixel voltage Vp21 of 40V is discharged to 0V by the first data voltage Vd1 of −20V and the common voltage Vcom of −20V. Subsequently, the pixel voltage Vp21 of 40V is charged in the display cell Clc by the first data voltage Vd1 of −20V and the common voltage Vcom of +20V.

In the reset time RT, a fourth pixel P22 is reset by a pixel voltage Vp22 of 40V charged by the second data voltage Vd2 of ±20V and the common voltage Vcom of ±20V. The pixel voltage Vp22 of 40V is charged in the display cell Clc by the second data voltage Vd2 of +20V and the common voltage Vcom of −20V. Afterward, the pixel voltage Vp22 of 40V is discharged to 0V by the second data voltage Vd2 of −20V and the common voltage Vcom of −20V. Subsequently, the pixel voltage Vp22 of 40V is charged in the display cell Clc by the second data voltage Vd2 of −20V and the common voltage Vcom of +20V.

In the selection time ST, pulse widths of the pixel voltages Vp become narrow in an order of the pixel voltage Vp11, the pixel voltage Vp21, the pixel voltage Vp12, and the pixel voltage Vp22. Thus, as illustrated in FIG. 8, grayscales are dimmed in an order of the first pixel P11, the third pixel P21, the second pixel P12, and the fourth pixel P22.

According to the embodiment of FIG. 9, it is possible to generate the pixel voltages Vp of 40V and 30V by using the data voltages Vd of ±20V and ±15V without damaging the switching device. Also, it is possible to drive the display device even though the polarity of the common voltage Vcom is reversed without the pre-discharging period, and thus a refresh time of the display device may be reduced.

Figure 10:
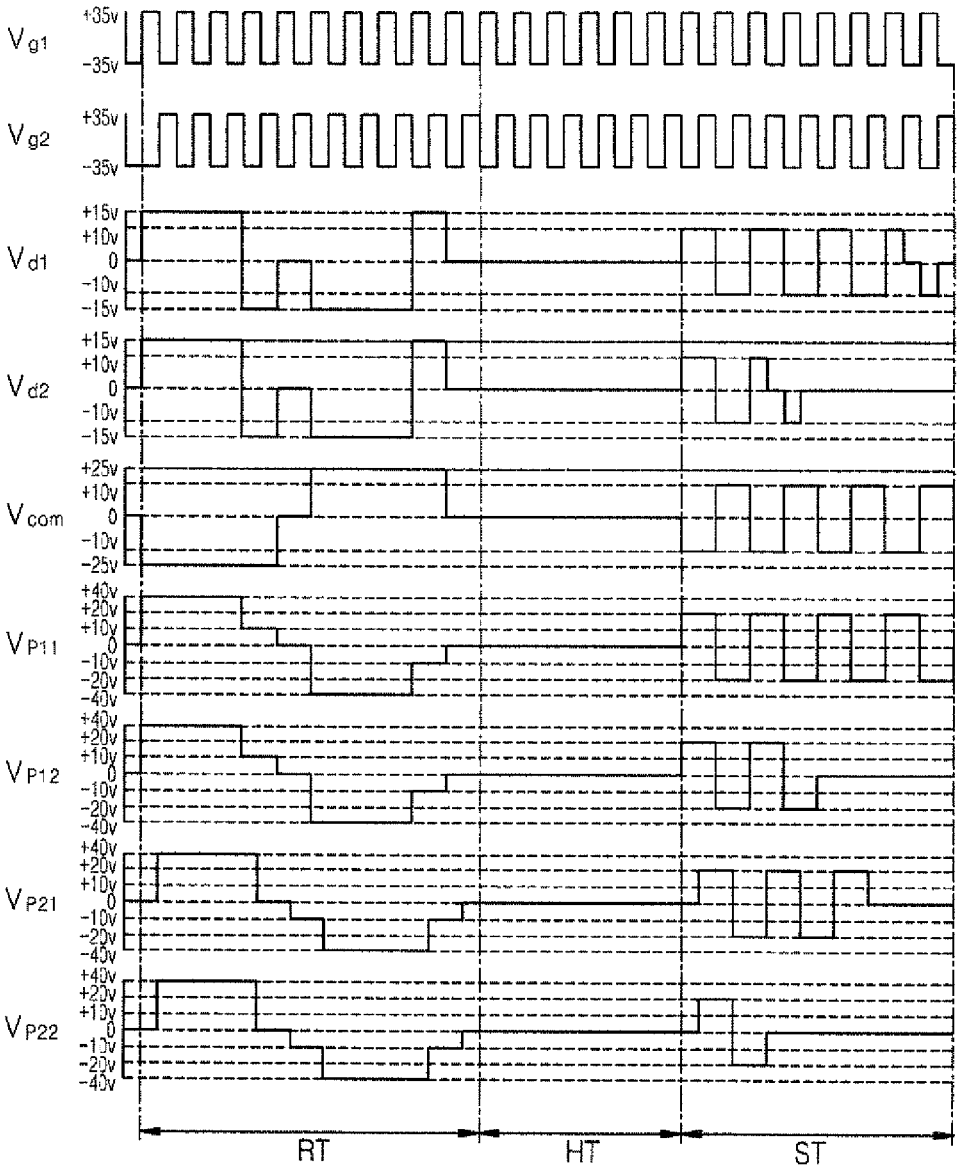
FIG. 10 is a timing diagram for describing a method of driving a display device according to another embodiment of the present invention.

FIG. 10 is a timing diagram for describing a method of driving a display device according to another embodiment of the present invention.

The method of FIG. 10 is related to a case in which the display device, in particular, a cholesteric liquid crystal display device, is driven by using a data voltage Vd of ±15V and ±10V and a common voltage Vcom of ±25V and ±10V, when a pixel voltage Vp for reset is required to be 40V and the pixel voltage Vp for grayscale expression is required to be 20V.

Referring to FIG. 10, the cholesteric liquid crystal display device is driven according to an order of a reset time RT for changing the the cholesteric liquid crystal display device to a homeotropic status, a holding time HT, and a selection time ST for expression of a grayscale corresponding to variable reflectance. The grayscale varies according to a number of pulses of the pixel voltage Vp.

In the embodiment of FIG. 10, driving of the reset time RT and the holding time HT is the same as that of the embodiment of FIG. 7, and thus detailed descriptions thereof will be omitted.

A first gate voltage Vg1 applied to a first gate electrode line and a second gate voltage Vg2 applied to a second gate electrode line sequentially and alternately output a voltage of +35V for turning on a switching device and a voltage of −35V for turning off the switching device. A first data voltage Vd1 applied to the first source electrode line and a second data voltage Vd2 applied to a second source electrode line alternately output voltages of +15V and −15V in the reset time RT, and output voltages of +10V and −10V in the selection time ST. The common voltage Vcom alternately outputs a voltage of +25V and a voltage of −25V in the reset time RT, and alternately outputs a voltage of +10V and a voltage of −−10V in the selection time ST.

In the selection time ST, a first pixel P11 expresses a grayscale according to a number of pulses of the pixel voltage Vp11 of 20V charged by the first data voltage Vd1 of ±10V and the common voltage Vcom of ±10V. The pixel voltage Vp11 of 20V is charged in a display cell Clc by the first data voltage Vd1 of +10V and the common voltage Vcom of −10V. Afterward, the pixel voltage Vp11 of 20V is charged in the display cell Clc by the first data voltage Vd1 of −10V and the common voltage Vcom of +10V.

In the selection time ST, a second pixel P12 expresses a grayscale according to a number of pulses of the pixel voltage Vp12 of 20V charged by the second data voltage Vd2 of ±10V and the common voltage Vcom of ±10V. The pixel voltage Vp12 of 20V is charged in the display cell Clc by the second data voltage Vd2 of +10V and the common voltage Vcom of −10V. Afterward, the pixel voltage Vp12 of 20V is charged in the display cell Clc by the second data voltage Vd2 of −10V and the common voltage Vcom of +10V.

In the selection time ST, a third pixel P21 expresses a grayscale according to a number of pulses of the pixel voltage Vp21 of 20V charged by the first data voltage Vd1 of ±10V and the common voltage Vcom of ±10V. The pixel voltage Vp21 of 20V is charged in the display cell Clc by the first data voltage Vd1 of +10V and the common voltage Vcom of −10V. Afterward, the pixel voltage Vp21 of 20V is charged in the display cell Clc by the first data voltage Vd1 of −10V and the common voltage Vcom of +10V.

In the selection time ST, a fourth pixel P22 expresses a grayscale according to a number of pulses of the pixel voltage Vp22 of 20V charged by the second data voltage Vd2 of ±10V and the common voltage Vcom of ±10V. The pixel voltage Vp22 of 20V is charged in the display cell Clc by the second data voltage Vd2 of +10V and the common voltage Vcom of −10V. Afterward, the pixel voltage Vp22 of 20V is charged in the display cell Clc by the second data voltage Vd2 of −10V and the common voltage Vcom of +10V.

In the selection time ST, the number of pulses of the pixel voltages Vp is decreased in an order of the pixel voltage Vp11, the pixel voltage Vp21, the pixel voltage Vp12, and the pixel voltage Vp22. Thus, as illustrated in FIG. 8, the grayscales are dimmed in an order of the first pixel P11, the third pixel P21, the second pixel P12, and the fourth pixel P22.

In the embodiment of FIG. 10, when the pixel voltages Vp for the expression of the gray scale is relatively low, the display device may be driven in the same manner as a general liquid crystal display (LCD) is driven without a discharging period in the selection time ST. Also, according to the embodiment of FIG. 10, it is possible to generate the pixel voltages Vp of 40V and 20V by using the data voltages Vd of ±15V and ±10V without damaging a switching device.

Figure 11:
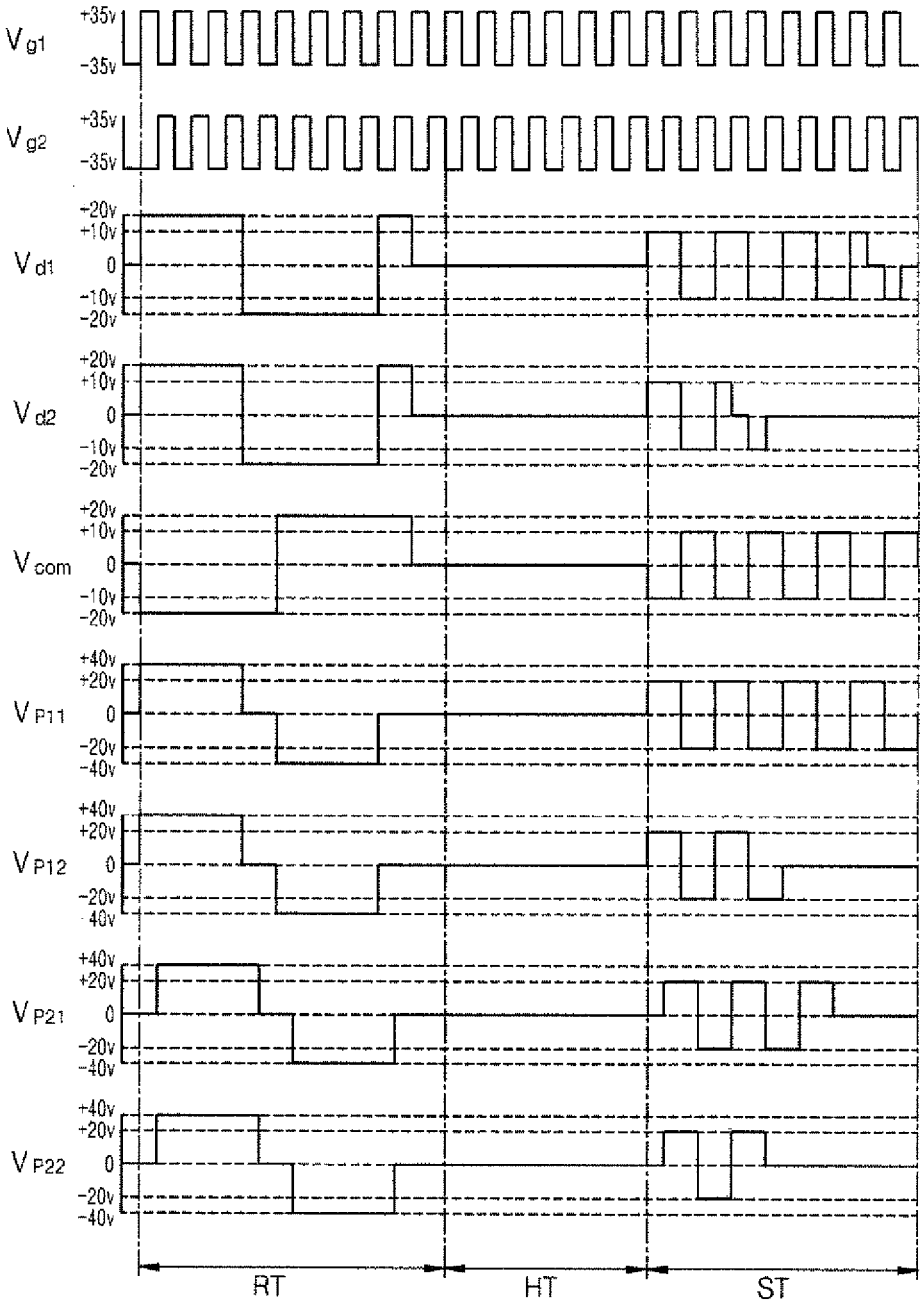
FIG. 11 is a timing diagram for describing a method of driving a display device according to another embodiment of the present invention.

FIG. 11 is a timing diagram for describing a method of driving a display device according to another embodiment of the present invention.

The method of FIG. 11 is related to a case wherein the display device, in particular, a cholesteric liquid crystal display device, is driven by using a data voltage Vd of ±20V and ±10V and a common voltage Vcom of ±20V and ±10V, when a pixel voltage Vp for grayscale expression is about 50% of the pixel voltage Vp for reset, and the data voltage Vd reaches 50% of the pixel voltage Vp for reset. In the present embodiment, the pixel voltage Vp of 40V for reset and the pixel voltage Vp of 20V for grayscale expression are required, and the data voltage Vd is available up to 20V.

Referring to FIG. 11, the cholesteric liquid crystal display device is driven according to an order of a reset time RT for changing the the cholesteric liquid crystal display device to a homeotropic status, a holding time HT, and a selection time ST for expression of a grayscale corresponding to variable reflectance. The grayscale varies according to a number of pulses of the pixel voltage Vp.

In the embodiment of FIG. 11, driving of the reset time RT and the holding time HT is the same as that of the embodiment of FIG. 9, and driving of the selection time ST is the same as that of the embodiment of FIG. 10, and thus detailed descriptions thereof will be omitted.

In the selection time ST, numbers of pulses of pixel voltages is decreased in an order of a pixel voltage Vp11, a pixel voltage Vp21, a pixel voltage Vp12, and a pixel voltage Vp22. Thus, as illustrated in FIG. 8, grayscales are dimmed in an order of a first pixel P11, a third pixel P21, a second pixel P12, and a fourth pixel P22.

In the embodiment of FIG. 11, when the pixel voltages Vp for the expression of the grayscale is relatively low, the display device may be driven in the same manner as a general LCD is driven without a discharging period in the selection time ST. Also, it is possible to drive the display device even though the polarity of the common voltage Vcom is reversed without the pre-discharging period, and thus a refresh time of the display device may be reduced. According to the embodiment of FIG. 11, it is possible to generate the pixel voltages Vp of 40V and 20V by using the data voltages Vd of ±15V and ±10V without damaging a switching device.

According to the one or more embodiments of the present invention, it is possible to drive the electrophoresis display device and the cholesteric liquid crystal display device by using a high withstand voltage without damaging the switching device.

While the present invention has been particularly shown and described with reference to exemplary embodiments thereof, it will be understood by those of ordinary skill in the art that various changes in form and detail may be made therein without departing from the spirit and scope of the present invention as defined by the following claims.

What is claimed is:

1. A method of driving a display device by using a pixel voltage corresponding to a difference between a common voltage and a data voltage, the method comprising the step of resetting the pixel voltage, wherein the resetting step comprises:

charging a first pixel voltage by the common voltage and the data voltage having opposite polarities; and discharging the first pixel voltage in a period wherein a polarity of the common voltage is reversed; and wherein the discharging step comprises:

discharging the first pixel voltage to a first level by the common voltage and the data voltage having same polarities; and discharging the first pixel voltage from the first level to a second level which is lower than the first level by the common voltage and the data voltage having same levels.

2. The method of claim 1, wherein, when the first pixel voltage outputs a voltage of the second level, the polarity of the common voltage is reversed.

3. The method of claim 1, further comprising the steps of:

expressing a grayscale according to a second pixel voltage which is lower than the first pixel voltage and which is charged by the common voltage and the data voltage having opposite polarities; and discharging the second pixel voltage in a period wherein the polarity of the common voltage is reversed.

4. The method of claim 1, wherein the display device comprises a cholesteric liquid crystal display device.

5. The method of claim 1, wherein the display device comprises an electrophoresis display device.

6. A method of driving a display device by using a pixel voltage corresponding to a difference between a common voltage and a data voltage, the method comprising the steps of:

resetting a first pixel voltage by discharging the first pixel voltage charged by the common voltage and the data voltage having opposite polarities in a period where a polarity of the common voltage is reversed; and expressing a grayscale according to a second pixel voltage which is lower than the first pixel voltage and which is charged by the common voltage and the data voltage having opposite polarities, and discharging the second pixel voltage in a period wherein the polarity of the common voltage is reversed.

7. The method of claim 6, wherein the resetting step comprises:

discharging the first pixel voltage to a first level by the common voltage and the data voltage having same polarities; and discharging the first pixel voltage from the first level to a second level by the common voltage and the data voltage having same levels.

8. The method of claim 6, wherein the discharging of the second pixel voltage comprises discharging the second pixel voltage to a third level by the common voltage and the data voltage having same polarities.

9. The method of claim 6, wherein the grayscale varies according to a pulse width of the second pixel voltage.

10. The method of claim 6, wherein the resetting step comprises discharging the first pixel voltage by the common voltage and the data voltage having same polarities and levels when the data voltage is not less than one-half of the first pixel voltage.

11. The method of claim 6, wherein the display device comprises a cholesteric liquid crystal display device.

12. The method of claim 6, wherein the display device comprises an electrophoresis display device.

13. The method of claim 6, further comprising a holding step in which the data voltage and the common voltage are not changed between the resetting step and the step of expressing the grayscale.

14. A method of driving a display device by using a pixel voltage corresponding to a difference between a common voltage and a data voltage, the method comprising the steps of:

setting a first pixel voltage by discharging the first pixel voltage charged by the common voltage and the data voltage having opposite polarities in a period wherein a polarity of the common voltage is reversed; and expressing a grayscale by a second pixel voltage which is charged by the common voltage and the data voltage having opposite polarities, wherein the setting step comprises:

discharging the first pixel voltage to a first level by the common voltage and the data voltage having same polarities; and discharging the first pixel voltage from the first level to a second level by the common voltage and the data voltage having same levels.

15. The method of claim 14, wherein the grayscale varies according to a number of pulses of the second pixel voltage.

16. The method of claim 14, wherein the second pixel voltage is one-half of the first pixel voltage.

17. The method of claim 14, wherein the display device comprises a cholesteric liquid crystal display device.

* * * * *